United States Patent [19]

Keller

[11] 4,360,936

[45] Nov. 30, 1982

[54] PIVOTING BED

[76] Inventor: Halbert J. Keller, 246 N. Main, Manti, Utah 84642

[21] Appl. No.: 182,024

[22] Filed: Aug. 28, 1980

[51] Int. Cl.[3] ..... A47C 19/00

[52] U.S. Cl. ..... 5/9 R; 5/11; 5/308; 5/507

[58] Field of Search ..... 5/8, 9 R, 9 B, 11, 308, 5/925, 1, 2 R, 3, 507; D6/79; 297/142, 349, 240; 182/100; 108/139–142

[56] References Cited

U.S. PATENT DOCUMENTS

| | | | |
|---|---|---|---|
| 238,406 | 1/1976 | Bobrick | 5/66 |
| 785,455 | 3/1905 | Vigie | 5/9 R |
| 1,220,578 | 3/1917 | Wise | 108/139 |
| 1,349,962 | 8/1920 | Janson et al. | 5/9 R |
| 1,894,991 | 1/1933 | Hayes | 108/140 |
| 2,462,524 | 2/1949 | Mattedi | 5/308 |
| 2,692,689 | 10/1954 | Wynne | 108/139 |
| 2,749,188 | 6/1956 | Mitchell | 182/100 |
| 2,792,951 | 5/1957 | White | 297/349 |
| 2,945,241 | 7/1960 | Sideroff | 5/9 R |
| 3,035,227 | 5/1962 | Sproule | 5/3 |
| 3,393,009 | 7/1968 | Tart | 297/349 |
| 3,486,790 | 12/1969 | Barecki et al. | 297/142 |

FOREIGN PATENT DOCUMENTS

| | | | |
|---|---|---|---|
| 1554106 | 11/1969 | Fed. Rep. of Germany | 5/10 |

*Primary Examiner*—Roy D. Frazier
*Assistant Examiner*—Michael F. Trettel
*Attorney, Agent, or Firm*—Bryant R. Gold

[57] ABSTRACT

A pivoting bed having at least one individual bed that is independently rotatable about a vertical support column. A support arm protrudes out from the vertical support column. At the end of this support arm, a single mounting point is provided to which a rectangular bed frame may be horizontally mounted. The bed frame, while remaining in its horizontal position, may pivot about the single mounting pivot of the support arm; and the support arm may, in turn, be pivoted about the vertical support column. The vertical support column is typically round, and the support arms are typically "L" shaped, including a vertical tube portion adapted to fit over the vertical support column and a horizontal arm portion adapted to transversly protrude away from the vertical tube portion. The single mounting point of the support arm is adapted to mate with a centrally located hub of the horizontal bed frame. In one embodiment of the invention, more than one bed may be pivotally mounted to the same vertical post, thereby providing a bunk bed arrangement wherein individual beds may be vertically stacked. In this embodiment, spacing collars adapted to fit over the vertical support column and between adjacent support arms may be utilized to vertically space the individual bed frames a desired distance apart. A telescoping adjustment allows the vertical support column to fit between a wide range of floor-to-ceiling heights. Optional railings may be selectively snapped to the sides of the bed. A drawer unit storage area may be mounted directly on the bed frame, in which case a mattress unit is placed over the drawer unit. If drawers are not desired, the mattress unit may be placed directly on the bed frame. A table or other horizontal surface may also be pivotally mounted to the vertical post by means of a separate support arm.

18 Claims, 6 Drawing Figures

PIVOTING BED

BACKGROUND OF THE INVENTION

This invention relates to beds and bed frames, and more particularly to an improved bed frame that allows easy and quick access to all sides thereof, and that optimally uses available room space.

Existing beds and bed frame design generally cater to one of two competing interests. A first interest is that of bed accessibility. That is, a user of the bed not only desires to be able to easily climb into and out of the bed, but those responsible for making up the bed (including keeping the linen changed and in neat order) also require easy access to all sides of the bed. Moreover, when the bed is used for a bedridden individual, such as a patient in a health care facility, it is important that those attending such a person also have easy access to all sides of the bed.

Unfortunately, easy access to all sides of a bed generally dictates that the bed be placed away from walls and corners of the room where it is kept. However, placing the bed in this fashion highlights the second competing interest, that being the efficient use of room space. That is, placing the bed away from corners and walls, makes for a very inefficient use of available room space. For the house having small bedrooms (which small bedrooms are becoming more and more common as housing costs soar), efficient use of room space is absolutely required, thereby greatly minimizing bed accessibility.

One existing solution to making more efficient use of bed space is that of the bunk bed, or vertically stacked beds. A trundle bed is also an example of vertically stacked beds, although they are vertically stacked only during storage. Improvements to the trundle bed concept have been suggested, such as is disclosed in Black, U.S. Pat. No. 3,325,830 (1967). However, while such improvements improve the efficient use of room space when the beds are stored, they do little to improve the accessibility of the beds when used. Moreover, when such beds are used, or in their operable position, the available room space in which the room occupants may move around without bumping into or walking over a bed is greatly diminished.

A significant problem with bunk beds, and similar vertically stacked arrangements, is the difficulty involved in making up the beds, changing the linen thereon, or having ready access to a patient lying thereon. These problems are particularly acute if the bunk bed is placed in a corner or against a wall, as is usually the case. Moreover, for an occupant of the bunk bed, especially the lower bunk, there is very little head space and often poor ventilation. Thus, the bed is not only difficult to make up, but it may also be an uncomfortable place in which to sleep. Because of these accessibility and comfort problems, vertically stacked beds are rarely considered as a viable option to many users, especially those users to whom bed space may be a premium, such as hospitals, or other health care facilities.

SUMMARY OF THE INVENTION

A principal object of the present invention is to provide an improved bed that makes efficient use of available floor and room space and that concurrently allows easy and quick access to all sides thereof.

A further object of the present invention is to provide such a bed that lends itself to vertical stacking, thereby increasing the number of beds that may be placed within a given area.

Another object of the present invention, when the invention is utilized in a vertical stacking mode, is to provide a significantly improved vertical stacking orientation wherein the individual beds are not only easily accessible, but also wherein all beds have adequate headroom and ventilation.

An additional object of the present invention is to provide an improved bed that not only is easily accessible and makes optimal use of available room space, but also includes, in one embodiment thereof, a storage area underneath each mattress of each bed, thereby adding to the available storage area within a defined area.

Still a further object of the present invention is to provide such a bed (that is easily accessible and that utilizes minimum floor space) in still another embodiment thereof that includes, as an integral part thereof, a horizontal working surface that may be quickly and easily moved to a usable position from the bed.

The above and other objects of the present invention are realized in an illustrative embodiment that includes a vertical post securely mounted between a floor and a ceiling. Pivotally connected to this vertical post, and transversely protruding therefrom, is at least one support arm to which a bed frame is attached so as to lie in a horizontal position. The bed frame is centrally mounted to the support arm at the end thereof so as to allow the bed to pivot or rotate about its mounting point. Thus, the support arm not only can pivot about the vertical post, but the bed frame, which is mounted to the end of the support arm, can also pivot within a horizontal plane about its mounting point at the tip of the support arm.

The vertical post is typically realized using a round pipe or column. The horizontal support arm has a relatively long round vertical tube adapted to slip over the round vertical post. Rigidly connected to a lower end of this round vertical tube is the support arm which protrudes transversely therefrom. When the vertical post is in a truly vertical orientation, the vertical tube of the support arm will be aligned therewith, and hence also truly vertical. The transverse support arm will thus be horizontal. Morever, because the support arm is rigidly connected to the round tube, (which, in turn is slipped over the round vertical post ), the support arm may be pivoted about the vertical post while remaining within the same horizontal plane.

At the tip of the horizontal support arm is a short vertical stub or pipe. This stub acts as a pivot and bearing point to which a bed frame may be pivotally attached. The bed frame includes a short hollow tube or pipe adapted to slip over the short vertical stub at the tip of the horizontal support arm. This short hollow tube is centrally located on the underneath side of the bed frame. Thus, when the bed frame is placed on the support arm, the bed frame may pivot about the vertical stub of the support arm, thereby allowing the bed to freely rotate within a horizontal plane so as to allow easy access to all sides thereof. Moreover, because the support arm itself may rotate about the vertical post, the entire frame may be swung or pivoted to any desired orientation.

More than one horizontal support arm may be utilized on the same vertical post, each support arm being in a different horizontal plane. When more than one bed frame is attached to each support arm, a bunk bed arrangement is thus realized wherein the orientation of each bed with respect to the vertical post and to the other beds is easily adjustable.

In one embodiment of the invention, a horizontal working surface may be pivotally attached to a separate support arm that transversely protrudes from the vertical post. This horizontal working surface may thus be pivoted to an easily accessible location from the bed, and hence serve as a table, tray, or similar working area which an occupant of the bed could use to write on, eat from, or for similar activities.

The vertical post advantageously includes a telescoping adjustment feature so that it may be conveniently mounted between floors and ceilings of various heights. Moreover, when more than one bed is attached to the same vertical post, as in a bunk bed arrangement, short rods may transversely be attached to the vertical tube of the lower support arm to serve as ladder rungs, thereby enabling a user of the upper bunk to easily climb thereto.

In another embodiment of the invention, a storage area may be sandwiched between the bed frame and a conventional mattress. In this fashion, needed storage space, typically in the form of drawers, is readily made available for use within the bedroom area.

BRIEF DESCRIPTION OF THE DRAWINGS

The above and other objects, features, and advantages of the invention will be more apparent from the following more particular description presented in connection with the accompanying drawings in which.

DESCRIPTION OF THE PREFERRED EMBODIMENTS

The invention is best understood by reference to the figures wherein like parts are designated with like numerals throughout.

Figure 1:
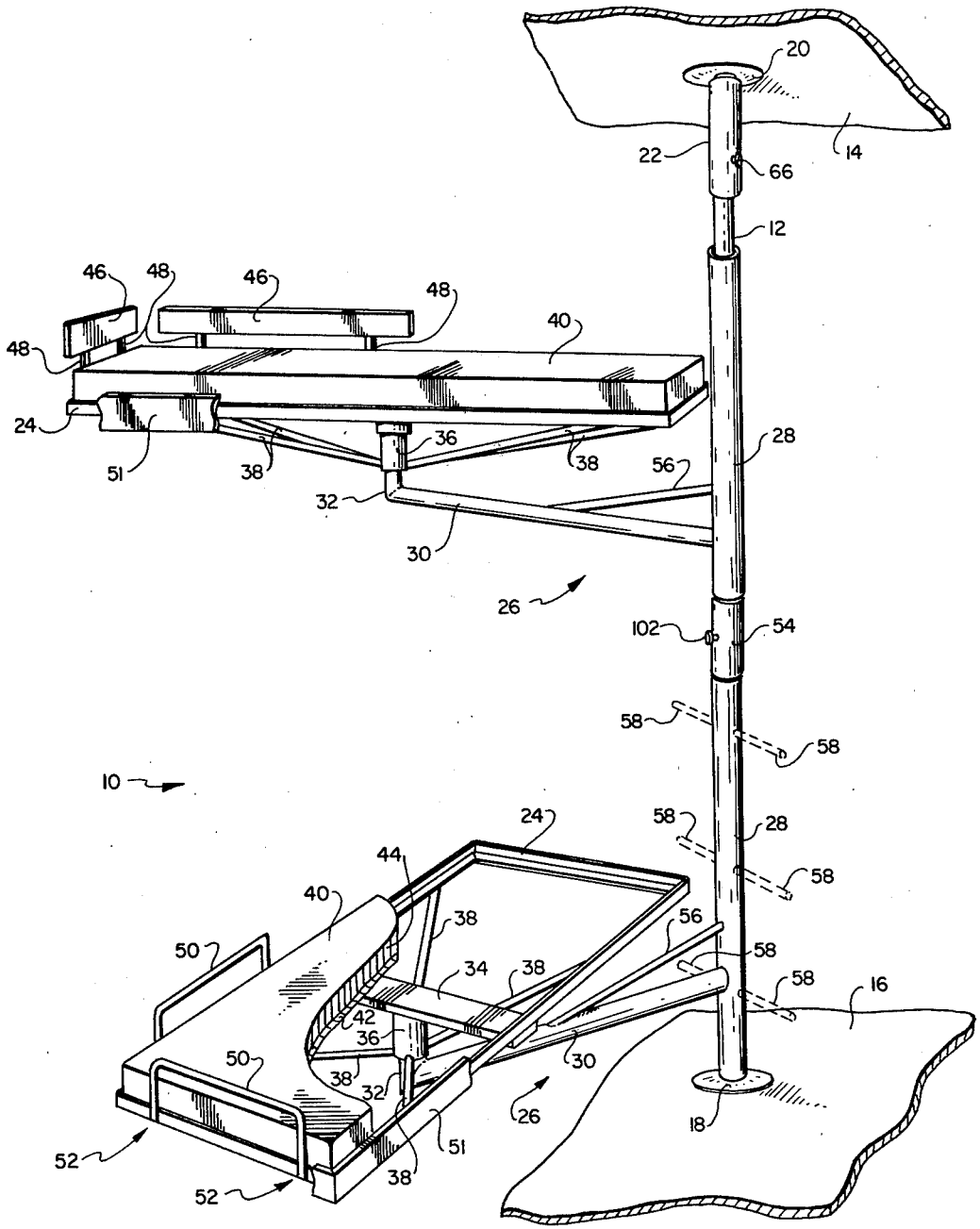
FIG. 1 is a perspective view of a pivoting bed embodying the invention, showing two beds in bunk bed fashion, the bottom bed of which has a portion of its mattress unit cut-away.

Referring first to the perspective view of FIG. 1, there is shown generally at 10 a pivoting bed of the type contemplated by the present invention. The bed includes a vertical post 12 securely mounted between a ceiling 14 and a floor 16. A floor plate 18 and a ceiling plate 20 are used to securely hold the post 12 in a desired vertical position. In order to insure the straightness, or verticalness, of the post 12, the ceiling plate 20 is generally installed first to the ceiling 14. A plumb line is then dropped therefrom in order to mark the location where the floor plate 18 is to be mounted. The post 12 is then mounted between the floor plate 18 and the vertical post 20. A telescoping section 22 allows the vertical height of the post 12 to be adjusted so as to allow it to fit between a wide variety of floor-to-ceiling heights.

A bed frame 24 is pivotally mounted to a horizontal support arm, shown generally at 26, which horizontal support arm transversely protrudes from the post 12. The horizontal support arm shown at 26 includes a vertical tube or pipe 28 that is slipped over the vertical post 12. The inside diameter of the vertical tube 28 is selected to be slightly larger than the outside diameter of the vertical post 12, thus allowing the vertical tube 28 to freely rotate about the post 12. Transversely mounted to the vertical tube 28 is a horizontal portion or arm 30 which extends out therefrom a sufficient distance to allow the bed frame 24 to at all times clear the post 12. At the end of the horizontal arm 30 is a relatively short vertical stub or finger 32. This vertical stub 32 serves as a bearing point upon which the bed frame 24 may be pivotally mounted, as more fully described below.

The bed frame 24 includes supporting structure adapted to support the entire frame from a central location thereof. A rigid crossbrace 34 is welded, or otherwise attached, midway between the long sides of the rectangular bed frame 24. On the underneath side of the crossbrace 34, in the middle thereof, a short section of tube or pipe 36 is also welded or otherwise attached. Support braces 38 radially protrude up from the bottom of this short section of pipe 36 to respective areas towards the ends of the long sides of the rectangular bed frames 24. A mattress unit 40, shown partially cut away on the lower bed of FIG. 1, may be placed on the frame 24 in order to provide a suitable surface upon which a person could sleep or otherwise rest. This mattress unit 40 would typically include a bedboard 42 upon which a suitable mattress 44 is placed. A set of box springs could be used, if desired, in place of the bedboard 42.

Suitable safety railings may be selectively placed around the perimeter of the bed frame 24. In one embodiment, the railings could be made from a slat 46 supported by vertical posts 48 that detachably connected to the bed frame 24, as shown in the upper bed of FIG. 1. Alternatively, the railings could be comprised of a single tube or rod 50 that is bent in an inverted "U" shape as shown in the lower bed of FIG. 1. Such railings are detachably connected to the bed frame 24 using an arrangement as shown best in the sectional view of FIG. 4.

Side trim 51 may optionally be attached around the perimeter of the bed frame 24 as partially shown in FIG. 1. This side trim 51 could be realized using wood, plastic, or similar material. It is used primarily to improve the appearance of the bed.

A spacing collar 54 of the same diameter as the vertical tubes or pipes 28 of the support arms 26 may be placed between adjacent support arms where more than one support arm is pivotally connected to the same vertical post 12. This collar 54 not only serves to vertically space two bed frames a desired distance apart, but it also acts as a buffer element between adjacent vertical tubes 28 so that rotation of one is not coupled to the other.

The rigidity of the support arms 26 is strengthened by means of a slanting support brace 56 tied between the horizontal portion 30 and the vertical tube 28.

Short horizontal rods 58, shown with dashed lines in FIG. 1, may be attached to the vertical tube 28 of a lower support arm to serve as ladder rungs so as to enable a user of an upper bed to easily climb thereto. However, for many applications, these horizontal rods 58 will not be needed inasmuch as the vertical spacing between beds can be made quite small, thereby making it relatively easy to step up to the higher bed from the floor or from the the lower bed.

Figure 2:
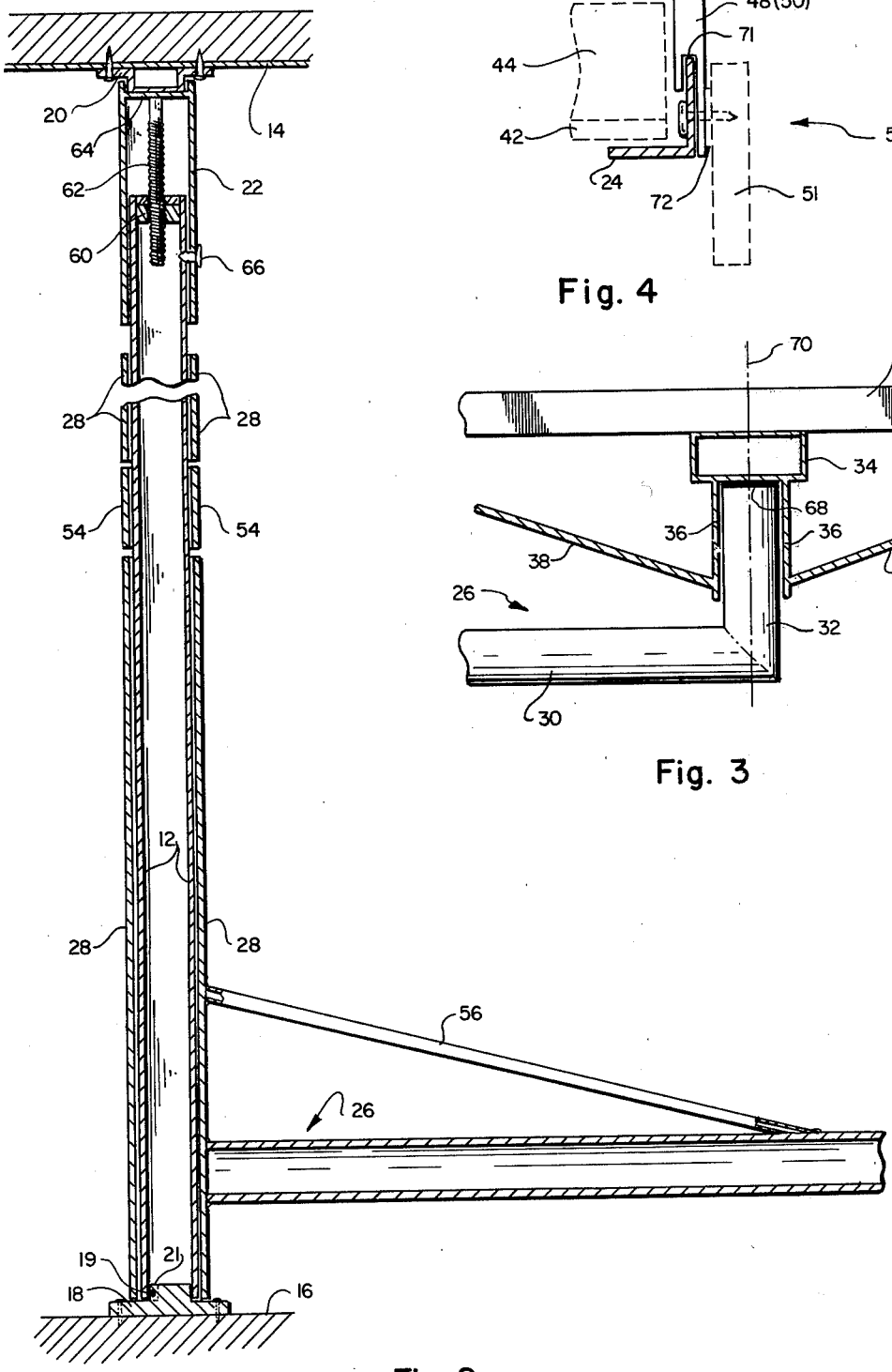
FIG. 2 is a partial cross-sectional view of the vertical post to which the bed frames are pivotally mounted by means of rotatable horizontal support arms.

FIG. 2 shows a partial cross-section of the vertical post 12 and a support arm 26 pivotally connected thereto. FIG. 2 also illustrates the details of mounting the vertical post 12 between a ceiling 14 and a floor 16. As seen in FIG. 2, the ceiling plate 20 and the floor plate 18 are securely mounted to the ceiling 14 and floor 16 respectively. These plates typically include a mounting flange through which suitable bolts, screws, or other mounting means may pass therethrough into a solid portion of the ceiling or floor. Each plate includes a center section adapted to fit inside of the vertical post 12 or the telescoping section 22. At the top of the vertical post 12 is attached a nut 60 through which a long threaded rod 62 may pass. At the top of the threaded rod 62 is a head portion 64 adapted to come in contact with the protruding portion of the ceiling plate 20. Thus, by turning the rod 62, the overall height of the vertical post 12 may be readily adjusted, thereby allowing the vertical post to fit snugly between the ceiling and floor plates. A knub 19 welded to the inside of the bottom of the post 12 is adapted to engage with a corresponding slot 21 located on the inside periphery of the bottom plate 18. This knub/slot arrangement prevents the post 12 from rotating. Thus, by securely tightening the threaded rod 62, a firm, secure vertical post 12 is realized. If desired, a tightening bolt or set screw 66 may be used in order to secure the telescoping unit 22 at its set heighth, although the use of such a set screw should not be required in light of the non-rotable mounting of the vertical post 12.

As thus configured, it is seen that the vertical post 12 does not rotate, but rather is firmly held in a set position. The vertical tubes 28 of the horizontal support arms 26, on the other hand, are free to rotate about the vertical post 12. The horizontal portion 30 of the support arm 26, which is securely fastened to the vertical tube 28, is thus free to pivot about the vertical post 12 within a given horizontal plane.

Figure 3:
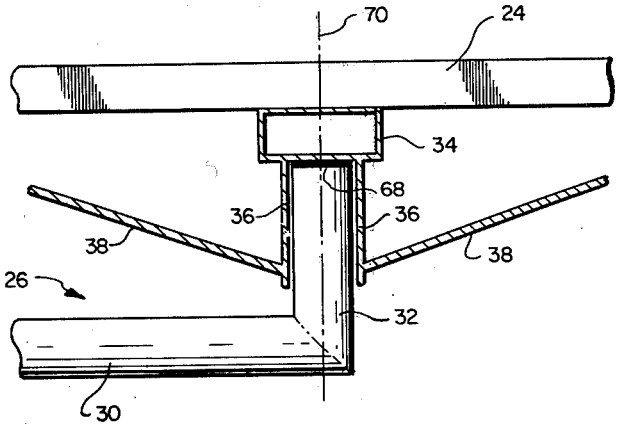
FIG. 3 is a sectional side view showing how the bed frame pivotally mounts to the end of the horizontal support arms.

The sectional view of FIG. 3 teaches how the bed frame 24, including its support structure, are pivotally mounted to the end of the support arm 26. At the end of each support arm, a short vertical stub or finger 32 extends in an upward direction. Attached to the underneath side of the brace 34 of the bed frame 24 is a short vertical tube or pipe 36. The inside diameter of the tube 36 is selected to be slightly larger than the outside diameter of the short stub 32. Thus, the pipe 36 may be slid over the stub 32 allowing a bearing surface 68 at the tip of the stub 32 to come in contact with the underneath side of the brace 34. The bed frame 24 is thus free to pivot about a central axis 70 defined by the center of the short stub 32.

Figure 4:
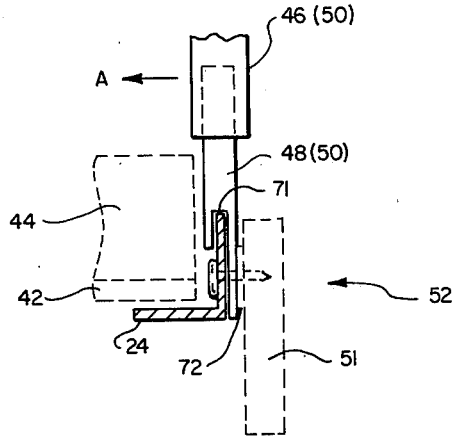
FIG. 4 is a sectional view depicting the manner in which side railings may be detachably coupled to the sides of the bed frame.

Referring now to FIG. 4, the preferred details of how the railings 46 (or 50) are detachably connected to the bed frame 24 at 52 are disclosed. The lower sections of the vertical post 48 (or vertical portions 50) of the railings have a slot 71 into which the top of the bed frame 24 may be inserted. Spacers 72 may selectively be fastened around the periphery of the bed frame 24. These spacers 72 serve to hold the trim 51 out away from the frame 24, and further define a gap into which the outside half of the lower sections of the vertical post 48(50) of the railings 46 may be slid. By carefully selecting dimensions of the spacer 72 and post 48, the railings 46 may thus be snuggly attached to the bed frame at any desired location.

Figure 5:
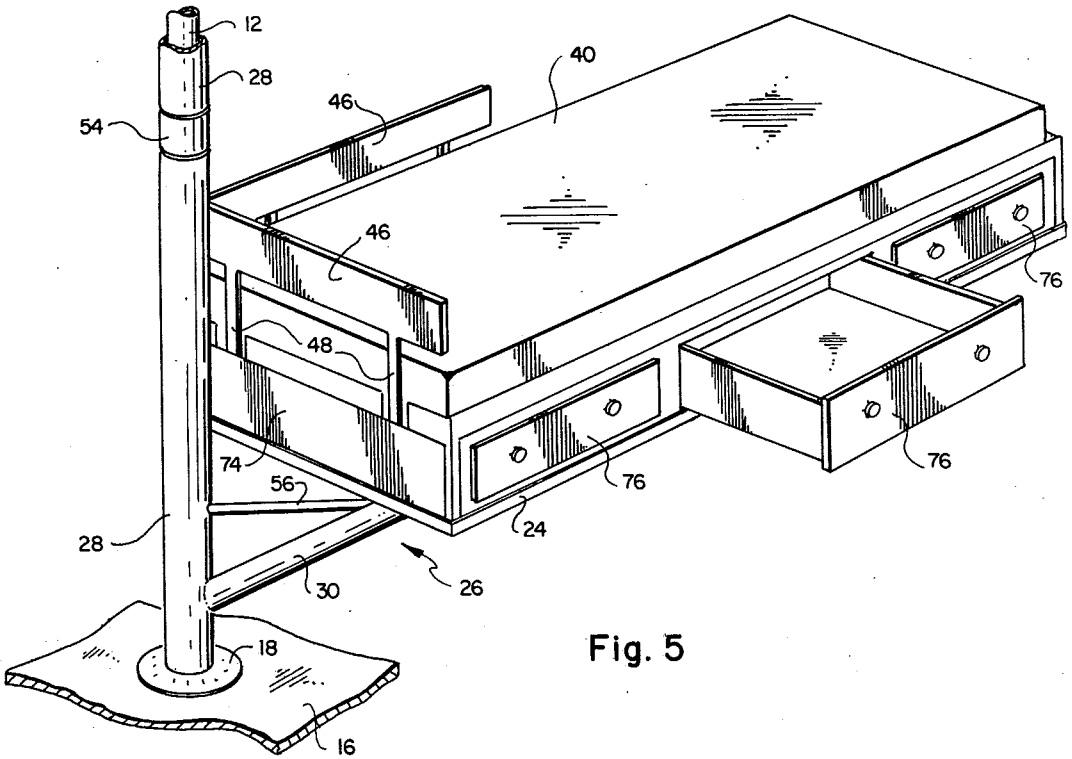
FIG. 5 is a perspective view of an alternative embodiment of the pivoting bed invention wherein a drawer storage unit is sandwiched between the bed frame and the mattress unit.

Referring next to FIG. 5, an alternative embodiment of the invention is shown that incorporates a storage area 24 sandwiched between the mattress unit 40 and the bed frame 24. This storage area 74 provides, in a preferred embodiment, a set of drawers 76 that may be slidably pulled from the storage area 74 in conventional manner. Preferrably, such drawers are accessible from both sides of the bed frame 24 (although only one side is shown in FIG. 5). As thus configured, the storage area 74 is thus an option which may be easily added to the pivoting bed 10 by merely inserting it on top of the bed frame 24 and laying the mattress unit 40 on top of the storage area 74. A storage area 24 such as that shown in FIG. 5 could be advantageously employed with each bed frame that is attached to the vertical post 12 (although only one bed is shown in the partial perspective view of FIG. 5).

Figure 6:
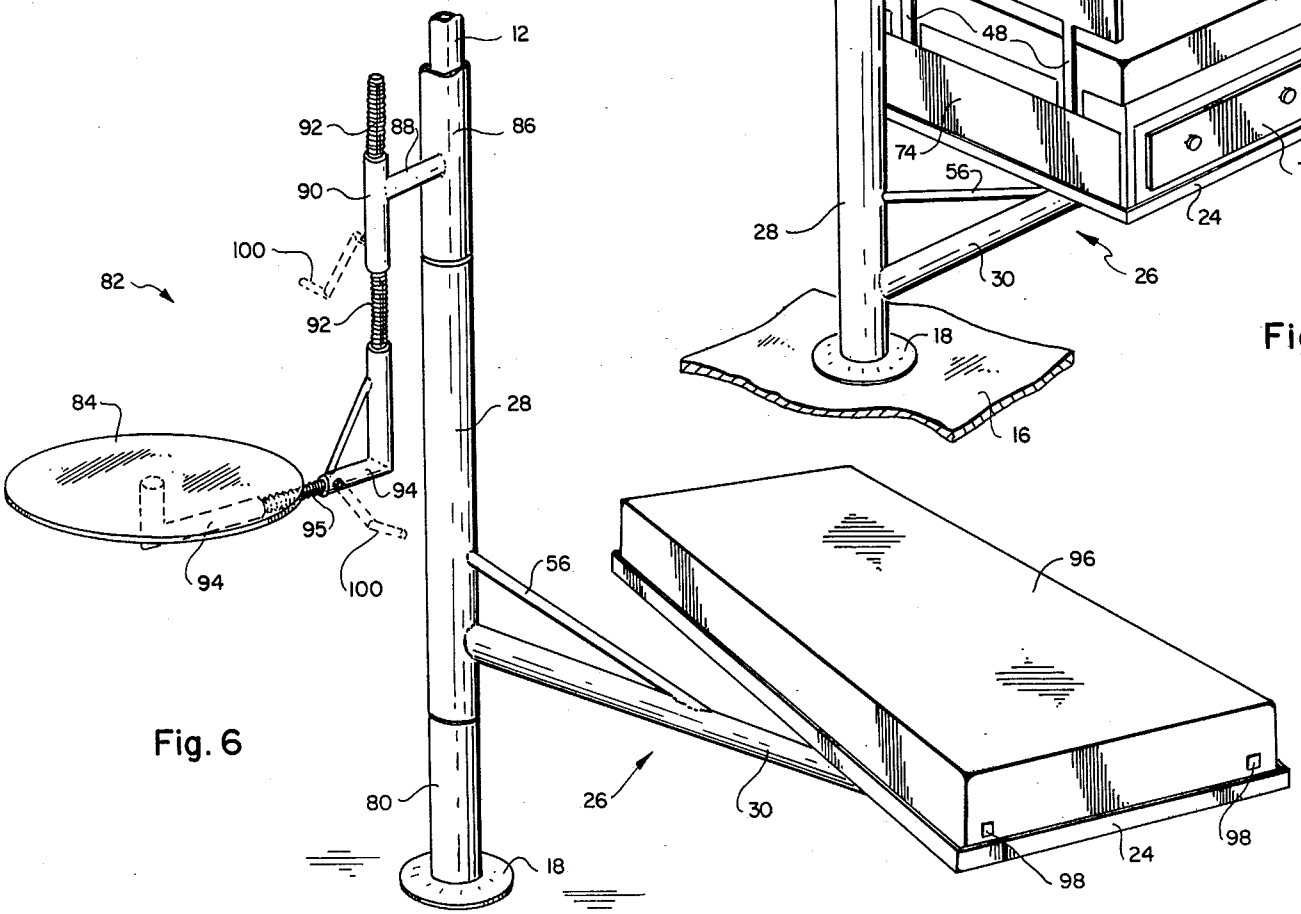
FIG. 6 is a perspective view of still another alternative embodiment of the invention wherein a rotatable, height-adjustable, horizontal working surface is also pivotally connected to the same vertical post to which the pivoting bed is also connected.

In FIG. 6, a perspective view is shown of an alternative embodiment of the invention that employs a bed frame 24 pivotally mounted to a support arm 26, which support arm is, in turn, pivotally mounted to a vertical post 12, as heretofore described. However, the embodiment shown in FIG. 6 further includes a rising collar 80 adapted to raise the support arm 26 a desired distance above the floor level. The embodiment also inlludes a hanging support arm shown at 82 which is adapted to hold a horizontal working surface 84 in a horizontal position. The hanging support arm 82 is configured similar to the support arms 26 in that it includes a vertical tube 86 to which a transversely protruding arm 88 is attached. However, in this case, the horizontal arm 88 attaches to a vertical section 90 that includes heighth adjustment means 92. This height adjustment means, in turn, is coupled to a support arm 94 of similar construction to the support arm 26, except that it includes extension means 95. The working surface 84 is pivotally mounted at the end of the support arm 94.

The configuration shown in FIG. 6 is ideally suited for a hospital or other health care facility wherein an occupant lying on the mattress unit 40 must be easily accessible from all sides. Moreover, such an occupant regularly needs a horizontal working surface, such as that shown at 84, which can be easily pivoted to a convenient position for him or her to use (such as an eating tray or writing surface, or even to hold medical apparatus). The height adjustment means 92 and the extension means 95 of the horizontal surface 84 could be easily operated by means of a hand crank that could be detachably connected by hospital personnel whenever the heighth or extension of the working surface 84 needed to be changed.

For the configuration of FIG. 6, instead of a conventional mattress unit 40 lying on the bed frame 24, a specially adapted mattress unit 96 could be employed. This mattress unit 96 would be of a type commonly found in hospitals and would include means so that various portions thereof could be raised or lowered relative to the frame 24. Moreover, it would include lifting means, such as the holes 98, whereby the entire unit could be easily raised off the frame 24 and moved to another location. As an example, specially adapted carts (that would function much as conventional fork-lifts) could be employed to lift the mattress unit off of the frame 24 when it is desired to wheel the patient to another location.

Because of the high degree of accessibility that is afforded by the configuration shown in FIG. 6 (as well as all of the figures disclosed herein), those attending the patient could easily and effectively attend to the patient's needs, including regularly changing the linen of the bed and placing the bed in a desirable orientation with respect to windows and other features within the hospital room. It would even be possible, where space is a premium, to employ more than one bed coupled to the same vertical post 12.

While numerous materials could be used to realize the invention herein disclosed, the preferred embodiment is presently realized by using the following materials. The vertical post 12 is realized using a 2 inch pipe having a length of about 84 inches. The rod 62 of the telescoping heighth adjustment is a $\frac{7}{8}$ inch threaded rod of about 18 inches in length. A matching nut is welded to the inside of the top of the vertical post 12. A suitable head 64, or bearing surface, is also welded to the top of the rod 62.

The vertical tube 28 of the support arms 26 may be realized using a schedule 40 $2\frac{1}{2}$ inch pipe; while the horizontal portion 30 and the vertical stub 32 may be realized using a schedule 80 2 inch pipe, all suitably welded to each other. The separating collar 54 may also be realized using a lenth of $2\frac{1}{2}$ inch pipe. A machine bolt or set screw 102 may advantageously pass through the collar 54 so as to securely hold the collar 54 to the vertical post 12. By firmly holding the collar 54 to the vertical post 12, in this fashion, the rotation of adjacent support arms 26 remains independent. All braces, such as the slanting brace 56 and the braces 38 employed to stiffen the bed frame 24 may be realized using black $\frac{1}{2}$ inch pipe (which is better for welding than galvanized pipe). The bed frame 24 may be realized using conventional angle iron that is welded in a rectangular frame. This frame is roughly 39 inches by 74 inches. The cross-brace 34, which is welded to the frame 24 may be realized using 3 inch channel iron.

In order to insure a smooth bearing surface upon which the bed frame may rotate, it is preferred that the short vertical stub 32 be realized using 2 inch seamless tubing. Typically this short stub will be $5\frac{1}{2}$ inches cut on a 45° angle (the short dimension being $5\frac{1}{2}$ inches), and the 45° angle being welded to a similar 45° angle cut in the 2 inch pipe used to realize the horizontal member 30 of the support arm 26. The smoothness realized using the seamless tubing for the short stub 32 allows the bed frame 24 to freely rotate about this pivot point. Alternatively, there are several spindals and similar mechanisms commercially available that could be used in place of the short stub 32 and mating hollow pipe 36 in order to allow the bed frame 24 to freely rotate about the end of the support arm 26.

The ladder rungs 58, if used, may be realized using any suitable rod, whether solid or hollow, that can be suitably welded or otherwise attached to the vertical tube 28 of a lower support arm 26. Typically, the spacing between successive rungs is set at 10 inches.

While the invention herein disclosed has been described by means of specific embodiments and applications thereof, numerous modifications and variations could be made thereto by those skilled in the art without departing from the spirit and scope of the present invention. It is therefore to be understood that within the scope of the appended claims, the invention may be practiced otherwise than as specifically described herein.

I claim:

1. A bunk bed for use inside a building structure comprising:

a single vertical post secured to said building structure;

a plurality of support arms pivotally attached to said vertical post;

a plurality of horizontal bed frames each pivotally attached to one of said support arms at the end of said support arm opposite that attached to said vertical post, each bed frame being adapted to hold a mattress unit upon a top side thereof.

2. A bunk bed as defined in claim 1 wherein said support arms each comprise:

a long vertical member adapted to slide over said vertical post;

a horizontal member attached at one end to said long vertical member; and a short vertical member attached to the other end of said horizontal member, an upper end of said short vertical member having pivot mounting means thereon for rotatably mounting said bed frame thereto such that said bed frame may rotate 360° in a horizontal plane.

3. A bunk bed as defined in claim 2 further including a sloping support brace connected between said long vertical member and said horizontal member.

4. A bunk bed as defined in claim 2 wherein said means for rotatably mounting said bed frame comprises:

a round short vertical member used as said short vertical member; and a round short vertical tube adapted to slip over said round short vertical member, said short vertical tube being attached at a top end thereof to the center of an underneath side of said bed frame.

5. A bunk bed as defined in claim 2 further including floor and ceiling mounting plates for securely holding said single vertical post in its vertical position between the floor and ceiling.

6. A bunk bed as defined in claim 5 wherein the vertical post includes an adjustable telescoping section for allowing said vertical post to be securely mounted in rooms of different ceiling heights.

7. A bunk bed as defined in claim 2 wherein the vertical post comprises a first round pipe and the long vertical member of each of said support arms comprises a second round pipe, said second pipe having a slightly larger diameter than said first pipe so that said second pipe can be slid over said first pipe and pivot 360° thereabout.

8. A bunk bed as defined in claim 2 further including a storage unit adapted to be placed between said bed frame and said mattress unit.

9. A bunk bed as defined in claim 8 wherein said storage unit includes drawers accessible from at least two sides of said bed frame.

10. A pivoting bed for use inside a building structure comprising:

a single vertical post secured to said building structure;

a rigid support arm having a first end thereof coupled to said post;

first pivot mounting means for allowing said support arm to pivot about said post when coupled thereto;

support means for rigidly holding said support arm in a desired orientation with respect to said post regardless of external forces applied to a second end thereof;

a bed frame mounted to said second end of said support arm, said bed frame adapted to lie in a horizontal place, and further adapted to hold a bed mattress unit thereon; and second pivot mounting means for allowing said bed frame, while remaining in said horizontal plane, to pivot 360° about said second end of said support arm.

11. A pivoting bed as defined in claim 10 wherein said first pivot mounting means comprises a slip tube placed around said post, said slip tube having the first end of said support arm rigidly connected at a desired angle thereto, and said tube further adapted to rotate about said post when manually turned.

12. A pivoting bed as defined in claim 11 wherein said desired angle is a right angle.

13. A pivoting bed as defined in claim 11 wherein said support means comprises said post and said slip tube having round cross-sections, the outside diameter of said post being only slightly smaller than the inside diameter of said slip tube, whereby said slip tube is maintained in close alignment with said post, said horizontal arm thus being maintained at said desired angle with respect to said post.

14. A pivoting bed as defined in claim 11 wherein said slip tube is at least three feet in length, said support arm being rigidly connected thereto at the desired angle towards a bottom end thereof.

15. A pivoting bed as defined in claim 10 wherein said second pivot mounting means comprises:

a round vertical stub placed at the second end of said horizontal support arm;

a bearing surface mounted at the top of said vertical stub; and a short round tube centrally mounted on the underneath side of said bed frame at right angles thereto, said short round tube adapted to slide over said round vertical stub when said bed , frame is mounted to said support arm, and to allow said bearing surface to come in contact with support structure of said bed frame.

16. A pivoting bed as defined in claim 15 further including:

a second support arm having a first end pivotally coupled to said post;

a horizontal working surface rotatably coupled to a second end of said second support arm; and means for adjusting the vertical heighth of said horizontal working surface relative to said horizontal plane of said bed frame.

17. A pivoting bed as defined in claim 16 further including means for adjusting the horizontal length of said second support arm.

18. A method of vertically stacking individual horizontal bed frames in an easily accessible arrangement, each of said frames being adapted to hold a mattress unit thereon upon which a person may sleep, said method comprising the steps of:

(a) vertically mounting a round post between floor and ceiling structure;

(b) pivotally mounting a horizontal support arm to said vertical post for each bed frame to be stacked, said support arm being substantially an "L" shaped member comprising a hollow round section adapted to slip over said round post, and a rigid section transversely protruding out from said hollow round section, said rigid section having a pivot point at the tip thereof upon which said bed frames can be rotatably mounted;

(c) mounting one of said bed frames on each of said support arms, said bed frames comprising a substantially rectangular structure adapted to be supported from the center thereof by said pivot point at the tip of the "L" shaped support arm.

* * * * *